US008366264B2

(12) United States Patent
Inaba et al.

(10) Patent No.: US 8,366,264 B2
(45) Date of Patent: Feb. 5, 2013

(54) HANDHELD TYPE PRINT LABEL PRODUCING APPARATUS

(75) Inventors: Takehiko Inaba, Aichi (JP); Keiji Seo, Aichi (JP); Toshihiro Takahashi, Aichi (JP); Hidenori Jo, Aichi (JP); Toshiyuki Furuyama, Aichi (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 210 days.

(21) Appl. No.: 12/722,041

(22) Filed: Mar. 11, 2010

(65) Prior Publication Data

US 2010/0302334 A1 Dec. 2, 2010

(30) Foreign Application Priority Data

Jun. 1, 2009 (JP) ..... 2009-132456

(51) Int. Cl.
*B41J 3/36* (2006.01)

(52) U.S. Cl. ..... 347/109; 400/88; 400/472; 400/586; 400/611; 400/691

(58) Field of Classification Search ..... None
See application file for complete search history.

(56) References Cited

U.S. PATENT DOCUMENTS

| | | | | |
|---|---|---|---|---|
| 4,264,396 | A * | 4/1981 | Stewart | 156/361 |
| 5,758,980 | A | 6/1998 | Takenaka | |
| 5,918,989 | A * | 7/1999 | Stout et al. | 400/88 |
| 6,503,005 | B1 * | 1/2003 | Cockerill et al. | 400/88 |
| 6,644,876 | B2 * | 11/2003 | Carriere et al. | 400/691 |
| 2005/0002715 | A1 | 1/2005 | Fries et al. | |
| 2008/0085142 | A1 | 4/2008 | Caveney et al. | |

FOREIGN PATENT DOCUMENTS

| | | |
|---|---|---|
| EP | 0798121 | 10/1997 |
| JP | 09 254450 | 9/1997 |
| WO | 2008122634 | 10/2008 |

* cited by examiner

*Primary Examiner* — Matthew Luu
*Assistant Examiner* — John P Zimmermann
(74) *Attorney, Agent, or Firm* — McCarter & English, LLP

(57) ABSTRACT

This disclosure discloses a handheld type print label producing apparatus comprising: a housing that has a dimension along a longwise direction that is longer than a dimension along a width direction, and has a grip portion; a cartridge holder provided at one side of said housing along said longwise direction; a power source holder provided at the other side of said housing along said longwise direction; and a motor that drives at least one roller positioned on a feeding path, that is driven by power supplied from said power source device; wherein: a plurality of mechanisms is disposed in the interior of said housing so that a position of the center of gravity along said longwise direction of said handheld type print label producing apparatus to which said cartridge and said power source device are mounted falls within a range of said longwise direction corresponding to said grip portion.

5 Claims, 7 Drawing Sheets

HANDHELD TYPE PRINT LABEL PRODUCING APPARATUS

CROSS-REFERENCE TO RELATED APPLICATION

The present application claims priority from Japanese Patent Application No. 2009-132456, which was filed on Jun. 1, 2009, the disclosure of which is incorporated herein by reference in its entirety.

BACKGROUND

1. Field

The present disclosure relates to a handheld type print label producing apparatus that produces printed labels and permits use while gripped by a user's hand.

2. Description of the Related Art

A handheld type print label producing apparatus generally comprises a power source holder in which power source device is mounted, a cartridge holder in which a cartridge is mounted, and a motor that is driven by the power supplied by the power source device. At the time of printed label production, with the power source device mounted in the power source holder and the cartridge mounted in the cartridge holder, at least one roller positioned on the feeding path of a label tape is driven by the motor to print desired print on the label tape fed out from the cartridge, thereby producing a printed label.

In the handheld type print label producing apparatus (printed tape producing apparatus) of the prior art, the motor (driving motor) and power source holder (battery part) are disposed separately on one end and the other end of the housing so that a heavy mechanism is disposed on both ends of the housing (case), thereby improving the weight balance.

In general, in the case of a handheld type print label producing apparatus that is used while gripped in the hand of a user, when the center of gravity of the entire apparatus is placed within the grip position, the user can receive the position of the center of gravity in the palm of his or her hand, making the apparatus easy to hold. With the apparatus easy to hold, the apparatus is also easy to operate while gripped.

In the handheld type print label producing apparatus of the above-described prior art, the heavy motor and power source holder are disposed on both ends of the housing, thereby positioning the center of gravity of the apparatus at the substantial center of the housing. Nevertheless, the position where the handheld type print label producing apparatus is gripped by the user is not necessarily limited to the center of the housing and may be off to one side or the other, depending on the housing shape. In such a case, the center of gravity of the apparatus is not positioned within the grip position in the above-described prior art. In the above-described prior art, therefore, the possibility exists that the portability and operability will not be favorably maintained by the grip position.

SUMMARY

It is therefore an object of the present disclosure to provide a handheld type print label producing apparatus that enables improvement in portability and operability by positioning the center of gravity of the apparatus within the grip position.

To achieve the above-mentioned object, an aspect of the present application comprises: housing that has a dimension along a longwise direction that is longer than a dimension along a width direction, and has a grip portion to be gripped by a hand of an operator; a cartridge holder provided at one side of the housing along the longwise direction, in which a cartridge configured to supply a label tape is mountable; a power source holder provided at the other side of the housing along the longwise direction, in which power source device is mountable; and a motor that drives at least one roller positioned on a feeding path of the label tape, that is driven by power supplied from the power source device; wherein: a plurality of mechanisms including the motor is disposed in the interior of the housing so that a position of the center of gravity along the longwise direction of the handheld type print label producing apparatus to which the cartridge and the power source device are mounted falls within a range of the longwise direction corresponding to the grip portion.

In the aspect of the present disclosure, a plurality of mechanisms including the motor is disposed within the housing so that the position of the center of gravity along the longwise direction of the handheld type print label producing apparatus with the cartridge and the power source device mounted is disposed within a range along the longwise direction corresponding to the grip portion. By positioning the center of gravity along the longwise direction of the apparatus in the range along the longwise direction of the grip portion, it is possible to position the center of gravity of the apparatus within the grip position when an operator grips the handheld type print label producing apparatus, making the apparatus easy to hold. With the apparatus easy to hold, the apparatus is also easy to operate while gripped. As a result, the portability and operability of the handheld type print label producing apparatus are improved.

Further, since the position of the center of gravity is received in the palm of the hand, the handheld type print label producing apparatus will not accidentally slip out of the hand of the operator as often, resulting in suppression of apparatus damage caused by dropping and the like.

DETAILED DESCRIPTION OF THE PREFERRED EMBODIMENTS

The following describes an embodiment of the present disclosure with reference to accompanying drawings. In the description, the terms front, rear, left, right, up, and down indicate the directions shown in FIG. 1 to FIG. 4, etc.

Figure 1A:
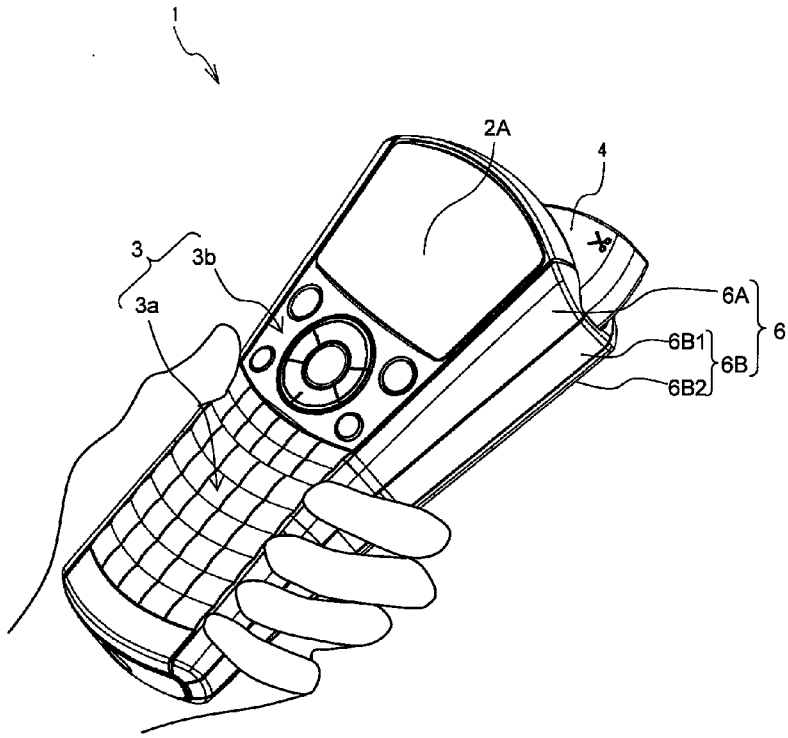
FIG. 1 is a perspective view showing the overall structure of the handheld type print label producing apparatus of the embodiment.
Figure 1B:
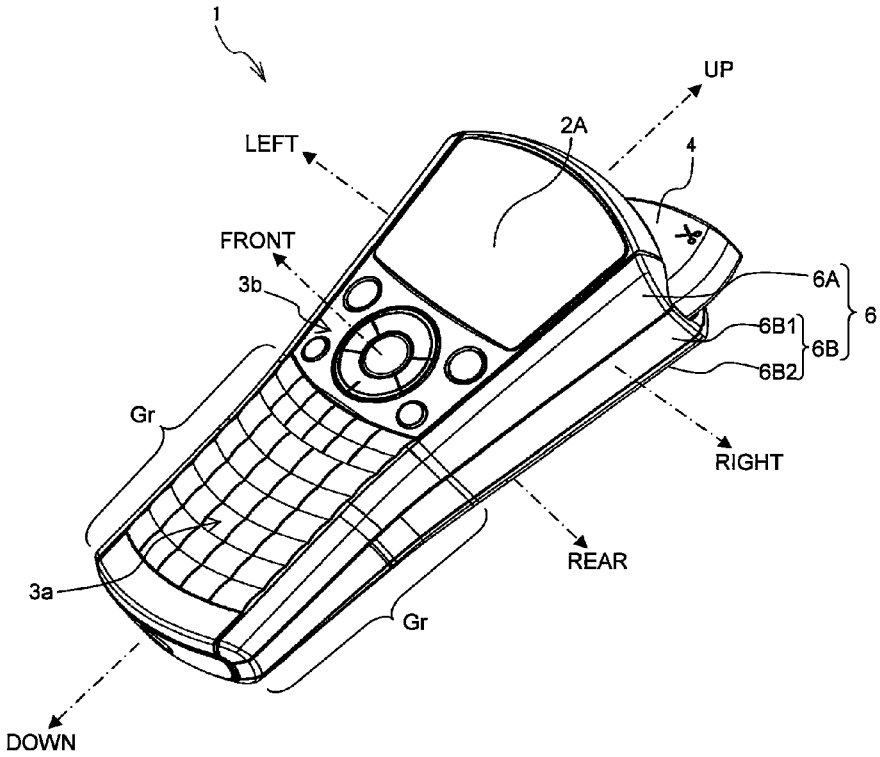

As shown in FIG. 1A and FIG. 1B, the handheld type print label producing apparatus 1 is a handheld type print label producing apparatus held in the hand by an operator. A housing 6 of this handheld type print label producing apparatus 1 comprises a front cover 6A that constitutes the apparatus front surface, and a rear cover 6B that constitutes the apparatus rear surface. Furthermore, the rear cover 6B comprises a rear cover main body 6B1 having various built-in mechanisms, and a removable cover 6B2 that can be removed from the rear cover main body 6B1 when installing or removing a cartridge 31 or a battery 8.

A liquid crystal display 2 for displaying print data, setting screens, and the like is provided on the upper side of the above-described front cover 6A. Note that the front surface of the liquid crystal display 2 is covered by a cover panel 2A, which is a transparent acrylic sheet, for example, and this cover panel 2A is shown in FIG. 1. A keyboard part 3 for operating the handheld type print label producing apparatus 1 is provided below the liquid crystal display 2. This keyboard part 3 includes character keys 3*a* of letters, symbols, numbers, and the like, and various function keys 3*b*. The keyboard part 3 (particularly, the character keys 3*a*) is centrally disposed in the vicinity along an up and down direction corresponding to a grip portion Gr described later. A cut button 4 for cutting a label tape 80 with print is provided at the right upper end of the above-described rear cover main body 6B1.

The side surfaces and rear surface of the above-described housing 6 (specifically, the left and right side surfaces of the front cover 6A, the left and right side surfaces of the rear cover main body 6B1, and the rear surface of the removable cover 6B2) constitute the grip portion Gr gripped in the hand of the operator. This grip portion Gr is positioned on the downward side of the housing 6 and is formed so that the size in the width direction (a left and right direction) is smaller than the other sections, thereby making it easy to grip by the operator. Note that, although not particularly provided in this embodiment, a rubber grip material or the like may be provided to at least a portion of the grip portion Gr.

Figure 2:
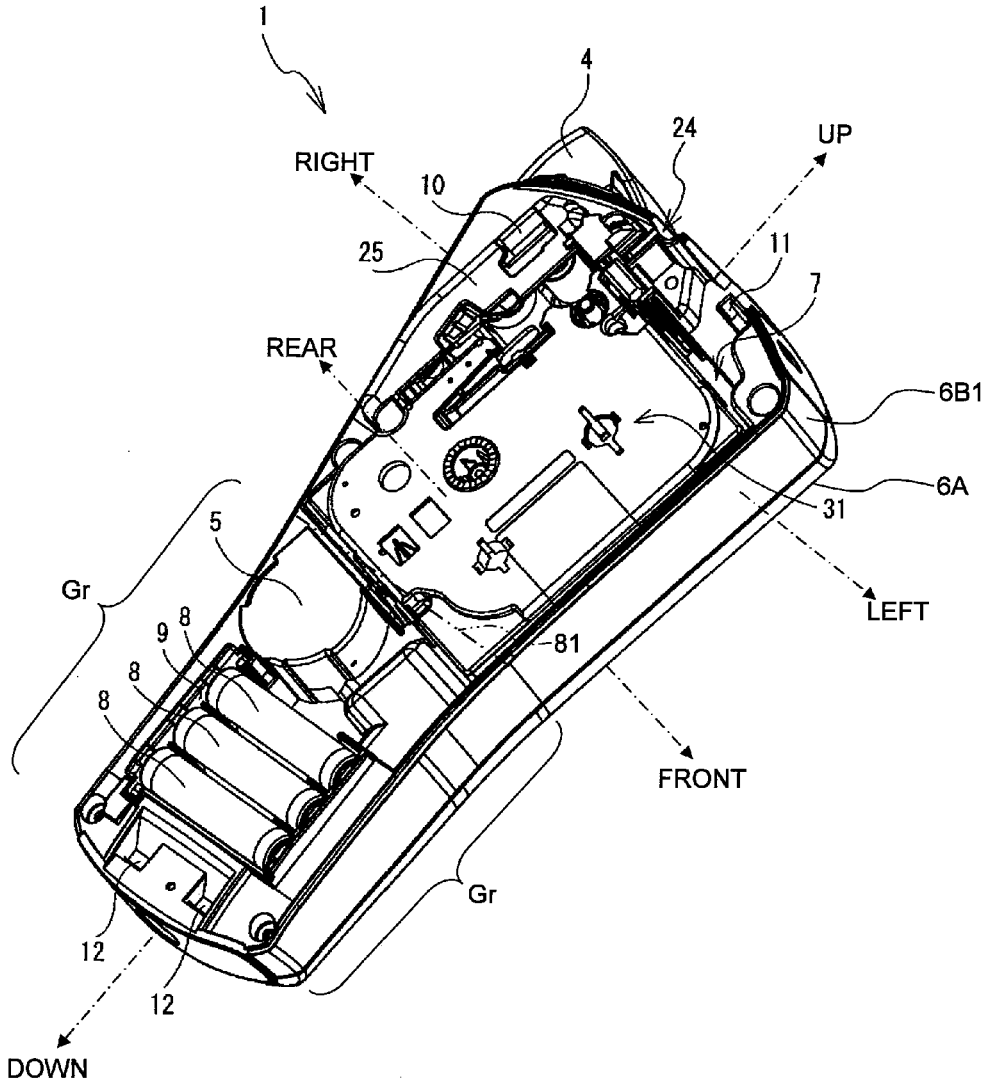
FIG. 2 is a perspective view showing the internal structure of the handheld type print label producing apparatus with the removable cover removed and the cartridge mounted in the cartridge holder.
Figure 3:
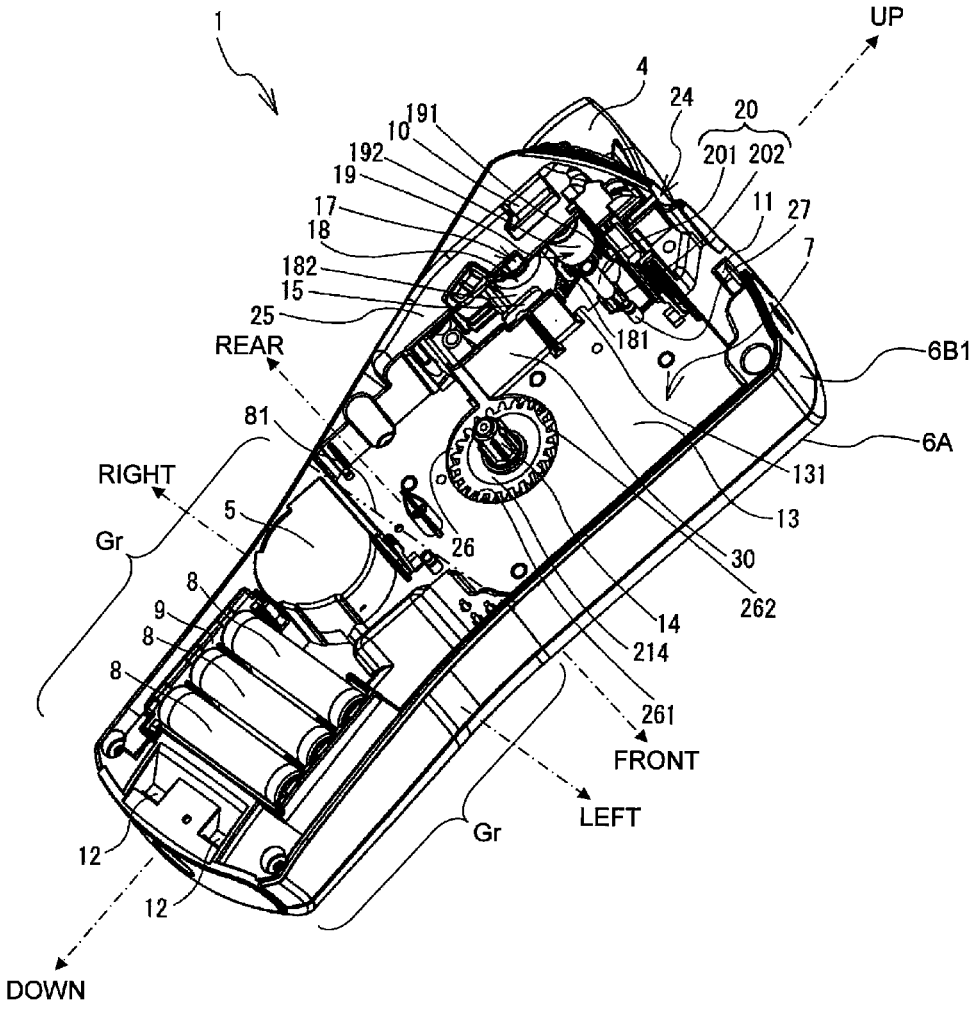
FIG. 3 is a perspective view showing the internal structure of the handheld type print label producing apparatus with the removable cover removed and the cartridge removed from the cartridge holder.
Figure 5:
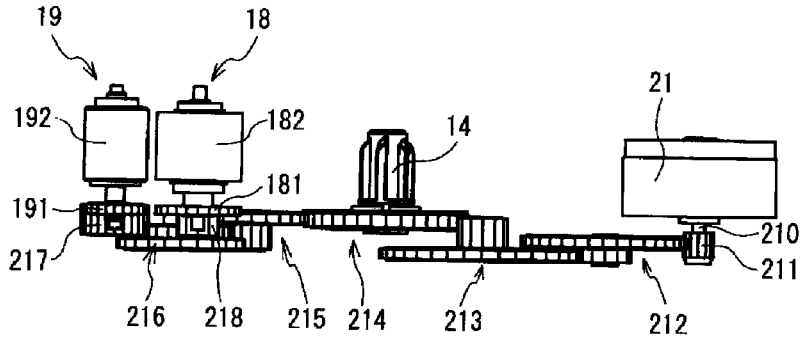
FIG. 5 is a side view showing the plurality of gears that constitute the power transmission path of the motor.

As illustrated in FIG. 2 and FIG. 3, the cartridge holder 7 having a rectangular shape in a plan view and formed in a concave manner for mounting the cartridge 31 is provided in the rear upper area of the rear cover main body 6B1. The cartridge 31 that supplies a cover film 51 (refer to FIG. 8 described later) on which printing is performed is mounted in the cartridge holder 7. A motor housing part 5 for housing a motor 21 (refer to FIG. 5 described later) is provided below the cartridge holder 7. This motor 21 is driven by the power supplied from the battery 8, and is for driving rollers 182, 192, etc., described later that are positioned on the feeding path of the cover film 51 (including the label tape 80 with print). A battery housing 9 for housing the battery 8 is provided further downward from the motor housing part 5, that is, in the lower part of the rear cover main body 6B1. It should be noted that a chargeable battery may be used in place of the battery 8.

As shown in FIG. 2 and FIG. 3, the above-described grip portion Gr extends across the entire range along the up and down direction of the housing 6 that is substantially below the cartridge holder 7. The long dash double-dotted line denoted by reference number 81 in FIG. 2 and FIG. 3 indicates the position of the upper end of the grip portion Gr. The motor housing part 5 that houses the motor 21 is disposed so that the position along the up and down direction thereof is disposed in the range along the up and down direction corresponding to the grip portion Gr (that is, in the range from the upper end position 81 of the grip portion Gr to the lower end position of the housing 6). Furthermore, the motor housing part 5 that houses the motor 21 and the battery housing part 9 are both disposed on the downward side (below the center along the up and down direction) of the housing 6. The gear structure for thus disposing the motor 21 downward within the housing 6 will be described later.

A tape discharging slit 24 for discharging the label tape 80 with print to the outside is provided on the upper side of the cartridge holder 7. A roller holder 17 (refer to FIG. 8 described later) is provided in the right upward area of the cartridge holder 7, and a plate 25 having a plate shape and made of synthetic resin is provided on the rear side of the roller holder 17. A protruding part insertion hole 10, which is an opening, is provided in the upper area of the plate 25. With the removable cover 6B2 installed to the rear cover main body 6B1, a protruding part (not shown) provided on the removable cover 6B2 is inserted into the protruding part insertion hole 10. With this arrangement, the roller holder 17 can be moved to a print position (the position shown in FIG. 8 described later), or to a standby position (the position shown in FIG. 2 and FIG. 3).

A lock hole 11 is provided in the upper end area, and two lock holes 12 are provided in the lower end area of the rear cover main body 6B1. When the removable cover 6B2 is installed on the rear cover main body 6B1, lock members (not shown) provided on the removable cover 6B2 engage with the lock holes 11 and 12, respectively. With this arrangement, natural release of the removable cover 6B2 is prevented.

Subsequently, the detailed structure of the cartridge holder 7 will be described. As shown in FIG. 3, the bottom surface of the cartridge holder 7 comprises a frame 13 made of synthetic resin. A frame end 131 serving as the right end area of the frame 13 is further provided on the right side of a rib 30 and a roller shaft 20 described later. A gear concave part 26 formed into a concave shape is provided at the substantial center of the frame 13. A gear 214 is provided on the gear concave part 26. A gear concave part first opening 261 is provided on the lower side of the gear concave part 26. The gear 214 engages with a gear 213 provided on the surface on the front side of the frame 13 via the gear concave part first opening 261. A gear concave part second opening 262 is provided on the upper side of the gear concave part 26. The gear 214 engages with a gear 215 (refer to FIG. 4 to FIG. 6 described later) provided on the surface on the front side of the frame 13 via the gear concave part second opening 262. Then, a ribbon take-up shaft 14 for rewinding an ink ribbon 55 is provided on the rear side of the gear 214. With this configuration, the power of the motor housed in the aforementioned motor housing part 5 is transmitted by the above-described plurality of gears, rotating the gear 214 and the ribbon take-up shaft 14.

A plurality of gears provided on the surface on the front side of the frame 13, including the above-described gear 214 and the gears 213 and 215 that engage therewith, is formed by synthetic resin, and the gear shafts (refer to FIG. 5 and FIG. 6 described later) that rotatably support these gears are also formed by synthetic resin and are integrated as a single unit with the frame 13.

It should be noted that, while FIG. 3 shows the teeth of the gear 214 exposed for ease of explanation, the teeth of the gear 214 are actually covered by an umbrella part (not shown) for concealment and not exposed.

As shown in FIG. 3, the rib 30 is provided on the right side of the ribbon take-up shaft 14. A heat sink 15, which is a rectangular radiator plate, is provided on the right side surface of this rib 30. Then, a thermal head 16 (refer to FIG. 8 described later) having a heating element is provided on the right side surface of the heat sink 15.

The roller shaft 20 (mechanism) is provided on the frame 13, between the rib 30 and the tape discharging slit 24. This roller shaft 20 is formed by synthetic resin, and is formed integrally as a single unit with the frame 13. The roller shaft 20 comprises a cylinder part 201 formed into a cylindrical shape, and six ribs 202 formed radially from the outer periphery of the cylinder part 201 toward the outside (refer to FIG. 8 described later). The roller shaft 20 is inserted into a shaft hole 391 (refer to FIG. 8 described later) of a feeding roller 39 provided on the cartridge 31, and rotatably supports the feeding roller 39.

A convex part 27 is provided on the left side of the roller shaft 20. The convex part 27 is inserted into a concave part (not shown) of the cartridge 31, thereby positioning the cartridge 31 in the front-rear direction.

Subsequently, the path in which the power from the motor 21 provided to the handheld type print label producing apparatus 1 is transmitted will be described by using FIG. 4 to FIG. 7

Figure 4:
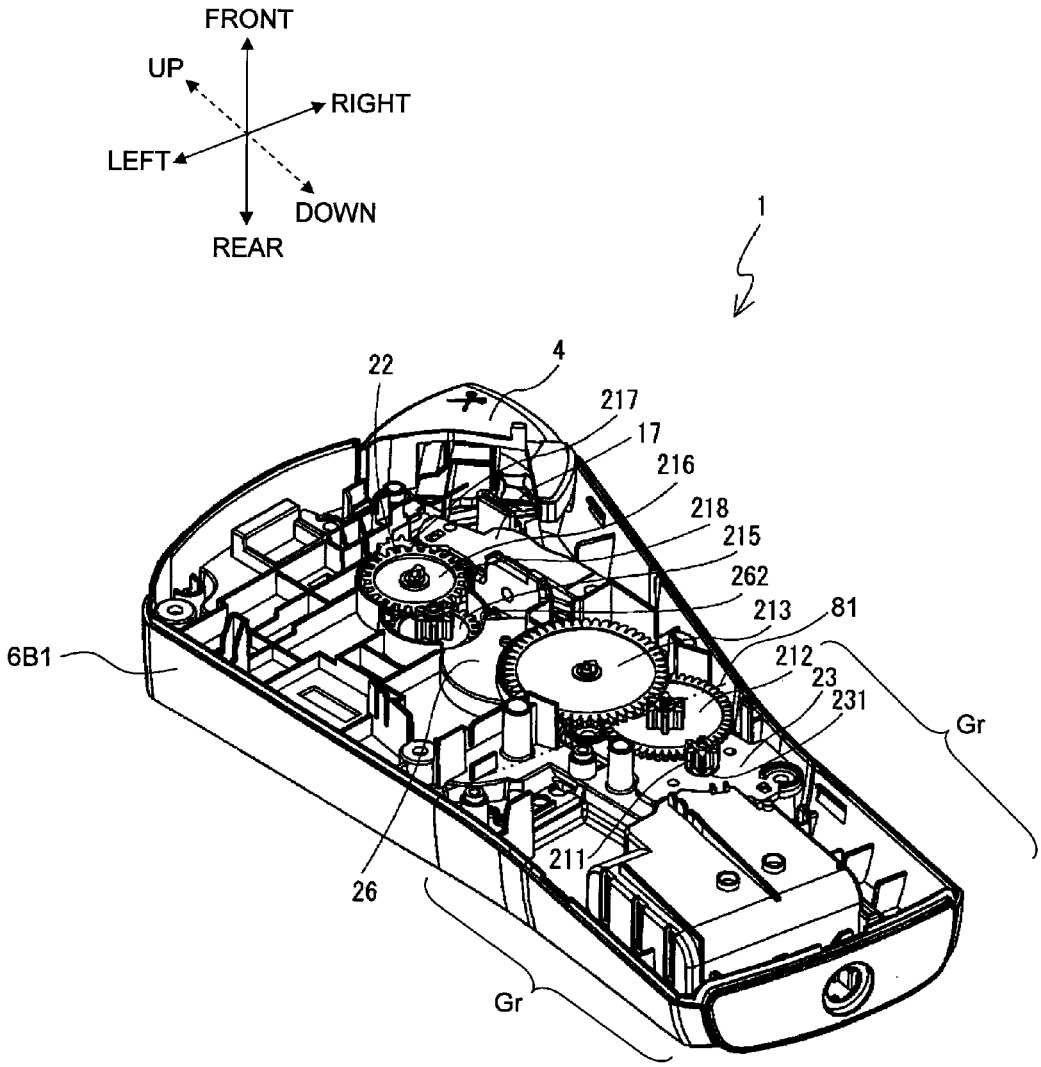
FIG. 4 is a perspective view showing the internal structure of the handheld type print label producing apparatus with the front cover removed.

As shown in FIG. 4 to FIG. 7, the plurality of gears 212 to 213 and 215 to 218 engages on the surface on the front side of the frame 13 of the cartridge holder 7. As shown in FIG. 4, a motor housing cover 23 is provided on the front side of the motor 21, the motor housing part 5 is provided on the rear side of the motor 21 as previously described, and the motor 21 is housed between the motor housing cover 23 and the motor housing part 5.

A drive gear 211 is fixed to a drive shaft 210 of the motor 21. This drive gear 211 is disposed on the front side of the motor housing cover 23 via a cover opening 231 provided on the motor housing cover 23.

The drive gear 211 engages with the gear 212. This gear 212 engages with the gear 213. The gear 213 engages with the gear 214 provided on the rear side of the frame 13 via the gear concave part first opening 261 provided to the aforementioned gear concave part 26. The ribbon take-up shaft 14 that rotates a ribbon take-up spool 57 (refer to FIG. 8 described later) is provided on the gear 214.

Furthermore, the gear 214 engages with the gear 215 via the gear concave part second opening 262 provided to the gear concave part 26. This gear 215 engages with the gear 216. Furthermore, the gear 216 engages with the gear 217 and the gear 218.

The above-described gears 212 to 213 and 215 to 218 are each rotatably supported by the plurality of gear shafts (not shown) provided on the surface on the front side of the frame 13. These gears 212 to 213 and 215 to 218 and the plurality of gear shafts are made of synthetic resin, and the plurality of gear shafts is integrally formed with the frame 13. Then, the plurality of gear shafts is disposed on the upper side of the motor housing cover 23 in which the motor 21 is housed as shown in FIG. 4.

Figure 6:
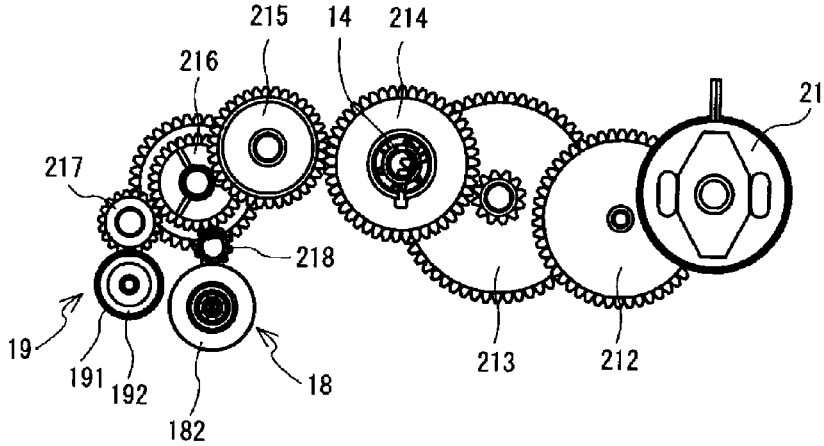
FIG. 6 is a rear view showing the plurality of gears that constitute the power transmission path of the motor.
Figure 7:
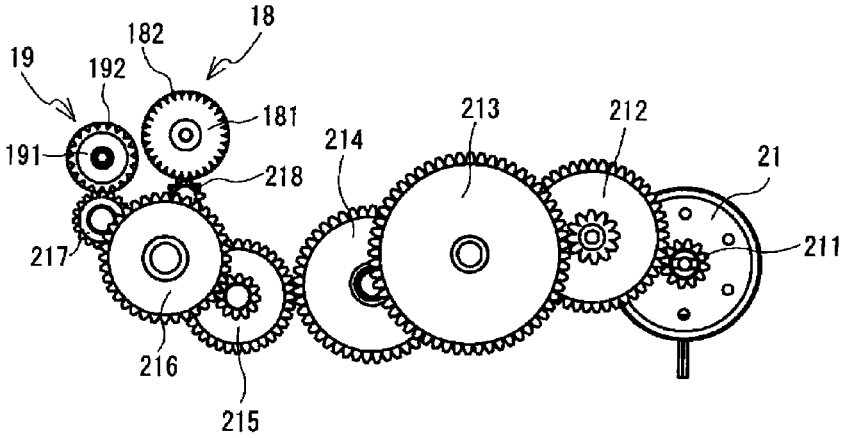
FIG. 7 is a front view showing the plurality of gears that constitute the power transmission path of the motor.

When the removable cover 6B2 is mounted on the rear cover main body 6B1, the roller holder 17 moves to the print position (the position shown in FIG. 8 described later). At this time, as shown in FIG. 6 and FIG. 7, a pressure roller gear 191 provided in the lower area of a pressure roller part 19 (refer to FIG. 5) provided to the roller holder 17 is biased in the direction of the gear 217 and engages with the gear 217. A platen roller gear 181 provided in the lower area of a platen roller part 18 (refer to FIG. 5) is biased in the direction of the gear 218 and engages with the gear 218.

Then, when the motor 21 is driven with the cartridge 31 mounted in the cartridge holder 7, the gear 214 rotates via the drive gear 211 and the gears 212 and 213. The rotation of the gear 214 then rotates the ribbon take-up shaft 14 provided to the gear 214, which in turn rotates the ribbon take-up spool 57. The rotation of the gear 214 is transmitted to the gears 217 and 218 via the gears 215 and 216. The rotation of the gear 217 is transmitted to the pressure roller gear 181 191, which rotates the pressure roller 192. The rotation of the gear 218 is transmitted to the platen roller gear 181, rotating the platen roller gear 181. Then, the rotation of the platen roller gear 181 rotates the platen roller 182.

Figure 8:
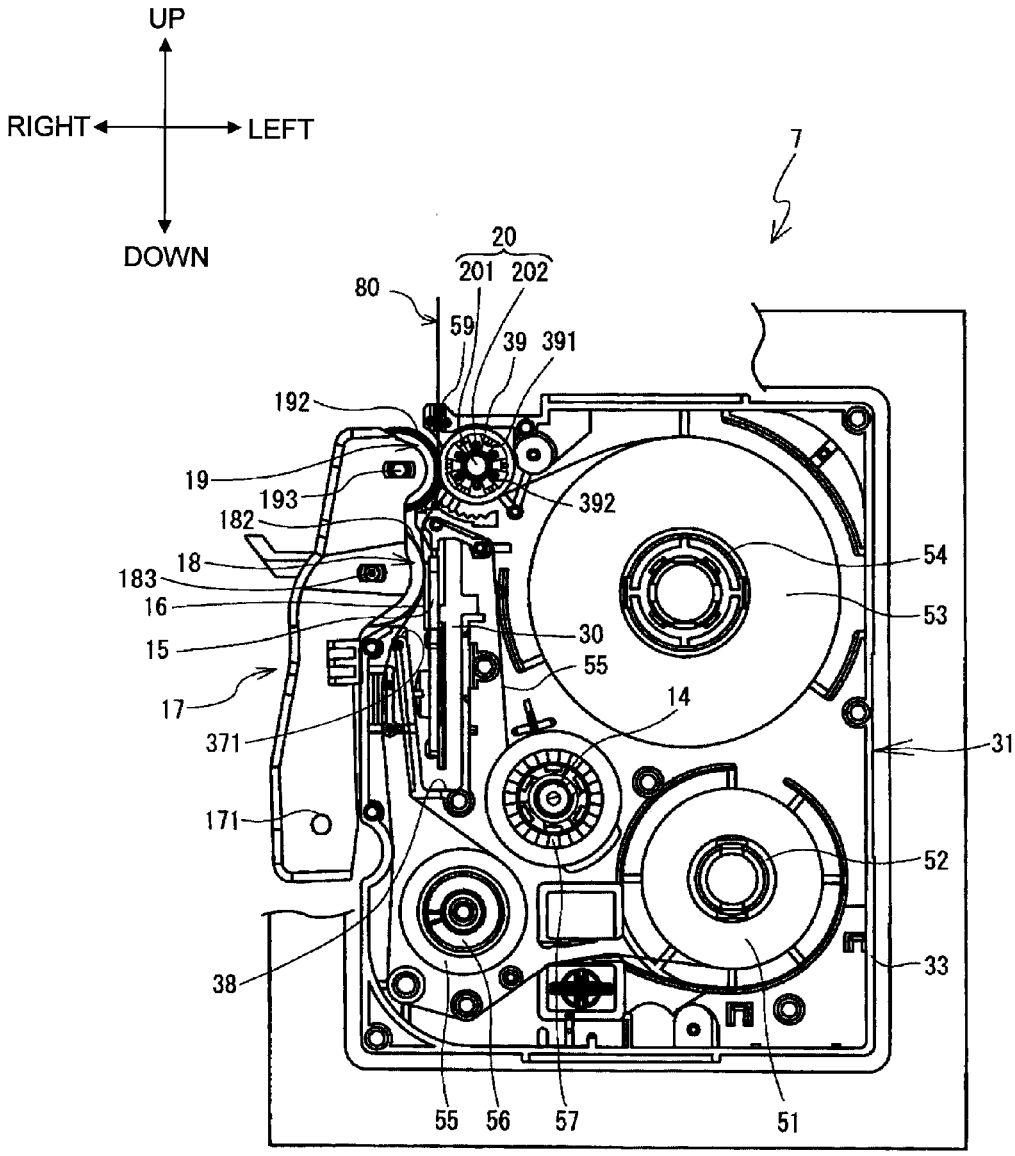
FIG. 8 is a plan view showing the internal structure of the cartridge.

FIG. 8 shows the internal structure of the cartridge 31 as well as the roller holder 17, the aforementioned rib 30, heat sink 15, thermal head 16, and the like, which constitute a part of the print mechanism of the handheld type print label producing apparatus 1.

As shown in FIG. 8, a cover film spool 52 around which is wound the transparent film-shaped cover film 51 is rotatably disposed in the lower left area within a cartridge case 33. The cover film 51 fed from this film spool 52 is guided toward a cartridge opening 371, and fed from the cartridge opening 371. A ribbon spool 56 around which the ink ribbon 55 is wound is rotatably disposed in the lower right area within the cartridge case 33. The ink ribbon 55 fed from this ribbon spool 56 is guided toward the cartridge opening 371, and fed along with the cover film 51.

The ribbon take-up spool 57 is rotatably disposed between the cover film spool 52 and the ribbon spool 56. This ribbon take-up spool 57 draws the ink ribbon 55 from the ribbon spool 56, winding the ink ribbon 55 that has been consumed from the printing of letters and the like.

A base tape spool 54 around which is wound a base tape 53 is rotatably disposed in the upper area within the cartridge case 33. The base tape 53 fed from the base tape spool 54 is guided toward the feeding roller 39 and pressed with the cover film 51 with print by the feeding roller 39 and the pressure roller 192 to form the label tape 80 with print, which is then fed toward a tape discharging exit 59.

The arm-shaped roller holder 17 comprising the platen roller part 18 and the pressure roller part 19 is provided on the right side of the cartridge 31 mounted to the cartridge holder 7 so that it is rockable in the left and right direction around a shaft support part 171. This roller holder 17, similar to the frame 13, is also made of synthetic resin. When the removable cover 6B2 is installed, the roller holder 17 is moved in the direction of the cartridge 31 by the aforementioned protruding part (not shown). With this arrangement, the pressure roller part 19 and the platen roller part 18 provided on the roller holder 17 are moved to the print position (the position shown in FIG. 8).

The above-described platen roller part 18 is disposed on the right side of the heat sink 15. The platen roller 182 and the platen roller gear 181 are provided on the platen roller part 18. The platen roller 182 is disposed in a position opposite the thermal head 16 provided on the right side surface of the heat sink 15. The platen roller gear 181 engages with the gear 218 provided on the front side of the frame 13 and, with the power transmitted from the motor 21, rotates, thereby rotating the platen roller 182. With this arrangement, when the platen roller part 18 moves to the print position, the platen roller 182 presses the cover film 51 and the ink ribbon 55 against the thermal head 16, feeding the cover film 51 on which letters, graphics, symbols and the like have been printed in the direction of the pressure roller part 19 by the rotation thereof.

The pressure roller 192 and the pressure roller gear 191 are provided on the pressure roller part 19. The pressure roller 192 is disposed in a position opposite the roller shaft 20. The pressure roller gear 191 engages with the gear 217 provided on the front side of the frame 13 and, with the power transmitted from the motor 21, rotates, thereby rotating the pressure roller 192. With this arrangement, when the pressure roller part 19 moves to the print position, the pressure roller 192 presses the cover film 51 and the base tape 53 against the feeding roller 39 rotatably supported by the roller shaft 20. With this arrangement, the cover film 51 on which printing was performed and the base tape 53 are pressed to form the label tape 80 with print, which is then discharged outside the handheld type print label producing apparatus 1 from the tape discharging slit 24.

The roller shafts 183 and 193 of the above-described platen roller 182 and pressure roller 192 are each made of synthetic resin. As described above, in the handheld type print label producing apparatus 1 of the present embodiment, roller shafts 20, 183, and 193 that rotatably support each of the rollers 39, 182, and 192, and the plurality of gear shafts that rotatably support the plurality of gears 212 to 218 that transmit the power of the motor 21 to the ribbon take-up shaft 14 and the rollers 182 and 192 are made of resin and formed integrally into a single unit with the frame 13 made of synthetic resin. With this arrangement, compared to a configuration in which the roller shafts, gear shafts, and frame on which these are provided are made of metal, a metal frame is not required, making it possible to reduce the weight and cost of the whole portion of the print label producing apparatus.

The greatest feature of the handheld type print label producing apparatus 1 of a configuration such as described above is the layout configuration of the plurality of mechanisms in the interior of the housing 6, which makes it possible to place a position of the center of gravity GV along the up and down direction of the entire apparatus in the range along the up and down direction corresponding to the grip portion Gr. This will now be discussed in detail, with reference to FIG. 9.

Figure 9:
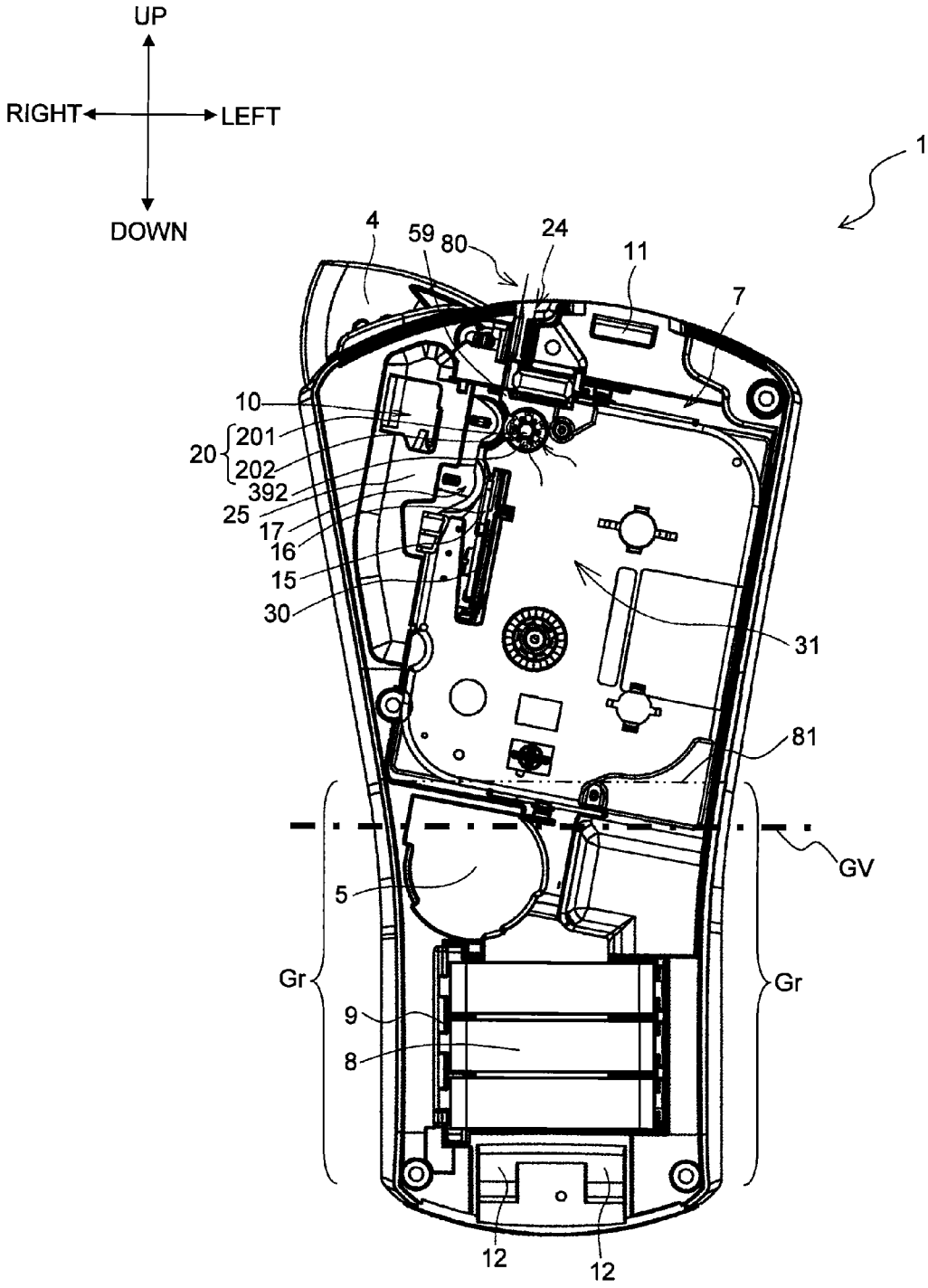
FIG. 9 is a plan view showing the internal structure of the handheld type print label producing apparatus with the removable cover removed, and corresponds to the FIG. 2.

As shown in FIG. 9, in the handheld type print label producing apparatus 1, the cartridge 31 is mounted on the cartridge holder 7, and the position of the center of gravity GV along the up and down direction of the entire apparatus with the battery 8 mounted in the battery housing part 9 is in the range along the up and down direction corresponding to the grip portion Gr. Here, the position of the center of gravity GV refers to the position along the up and down direction of the center of gravity (the center of gravity expressed by a point; hereinafter "the point of the center of gravity"). The position along the left and right direction of the point of the center of gravity is not particularly limited and does not necessarily need to be at the center along the left and right direction. Thus, in FIG. 9, the position of the center of gravity GV is expressed by the line parallel to the left and right direction (the long dash one-dotted line). Also, while FIG. 9 shows the removable cover 6B2 removed in order to show the internal structure, the above-described position of the center of gravity GV is the position of the center of gravity of the entire handheld type print label producing apparatus 1 with the removable cover 6B2 installed.

With the position of the center of gravity GV disposed in the range along the up and down direction corresponding to the grip portion Gr, the handheld type print label producing apparatus 1 has the following configuration, in particular. That is, as shown in the aforementioned FIG. 4, the gears 212 to 218 are disposed along the up and down direction on the front side of the frame 13, shifting the installation location of the motor 21 downward and disposing the position along the up and down direction thereof in the range along the up and down direction corresponding to the grip portion Gr. As described above, the motor 21 and the battery housing part 9 are both disposed on the downward side (below the center along the up and down direction) of the housing 6. With the motor 21, which is a heavy object, and the battery housing part 9, which is a heavy object when the battery 8 is mounted, both disposed on the downward side of the housing 6, the position of the center of gravity of the entire apparatus is shifted downward, positioning the position of the center of gravity GV within the grip position.

Further, as described above, the roller shafts 20, 183, and 193 that rotatably support each of the rollers 39, 182, and 192, the plurality of gears 212 to 218 that transmit the power of the motor 21 to the ribbon take-up shaft 14 and the rollers 182 and 192, and the plurality of gear shafts that rotatably support each of these plurality of gears 212 to 218 are formed by synthetic resin. With this arrangement, compared to a configuration in which the roller shafts, gear shafts, and frame on which these are provided are made of metal, the weight on the upward side of the apparatus where these mechanisms are mainly disposed can be decreased, making it possible to shift the center of gravity of the entire apparatus downward and position the position of the center of gravity GV within the grip position.

According to the handheld type print label producing apparatus 1 of the above-described embodiment, at the time of printed label production, the battery 8 is mounted in the battery housing part 9 provided on the lower side of the housing 6, and the cartridge 31 is mounted in the cartridge holder 7 provided on the upper side of the housing 6. Then, the platen roller 182 and the pressure roller 192 positioned on the feeding path of the cover film 51 are driven by the motor 21, and desired printing is performed on the cover film 51 fed from the cartridge 31, thereby producing a printed label.

At this time, a plurality of mechanisms including the motor 21 is disposed within the housing 6, making the position of the center of gravity GV along the up and down direction of the handheld type print label producing apparatus 1 with the cartridge 31 and the battery 8 mounted fall in the range along the up and down direction corresponding to the grip portion Gr. By positioning the position of the center of gravity GV along the up and down direction of the apparatus in the range along the up and down direction of the grip portion Gr, it is possible to position the center of gravity of the apparatus within the grip position when an operator grips the handheld type print label producing apparatus 1 in his or her hand, making the apparatus easy to hold. With the apparatus easy to hold, the apparatus is also easy to operate while gripped. Thus, the portability and operability of the handheld type print label producing apparatus 1 are improved. Further, since the position of the center of gravity is received in the palm of the hand, the handheld type print label producing apparatus 1 will not accidentally slip out of the hand of the operator as often, making it possible to suppress apparatus damage caused by dropping and the like.

In particular, in the present embodiment, the motor 21 is disposed so that its position along the up and down direction falls in the range along the up and down direction of the housing 6 corresponding to the grip portion Gr. With the motor 21, which is a heavy object that greatly affects the position of the center of gravity of the handheld type print label producing apparatus 1, disposed in the range along the up and down direction corresponding to the grip portion Gr, the center of gravity of the handheld type print label producing apparatus 1 can be reliably positioned within the grip position of the operator.

Further, in particular, in the present embodiment, the following advantage can be achieved. That is, a variety of mechanisms and members, such as a control substrate (not shown), the liquid crystal display 2, the battery housing part 9, the cartridge holder 7, the motor 21, the gears 212 to 218, and the rollers 39, 182, and 192, are provided within the housing 6 of the handheld type print label producing apparatus 1. Then, the battery 8 is mounted in the battery housing part 9, and the cartridge 31 is mounted in the cartridge holder 7 at the time of printed label production. At this time, the battery 8 mounted in the battery housing part 9, similar to the motor 21, is heavy in weight and greatly affects the position of the center of gravity of the handheld type print label producing apparatus 1.

Here, in the handheld type print label producing apparatus 1 of the present embodiment, of the above-described variety of mechanisms and members, the motor 21, which is a heavy object, and the battery housing part 9, which is a heavy object when the battery 8 is mounted, are disposed on the downward side of the housing 6. This makes it possible to shift the center of gravity of the entire apparatus from the center along the up and down direction to the downward side where the heavy objects are disposed, thereby reliably positioning the center of gravity within the grip position. Further, the great number of mechanisms and members other than the above-described heavy objects that are light can be disposed collectively on the upward side of the housing 6.

Further, in particular, in the present embodiment, the following advantage can be achieved. That is, in a print label producing apparatus in general, high rigidity is required in the gear shafts that rotatably support the gears that transmit the power of the motor to rollers, and thus metals having high rigidity are used for the gear shafts and the frame on which the gear shafts are provided.

In the handheld type print label producing apparatus 1 of the present embodiment, the frame 13 which corresponds to the above-described frame and the above-described gear shafts are made of synthetic resin, and the gears 212 to 218 supported by the gear shafts are disposed on the upward side from the motor 21. With this arrangement, it is possible to decrease the weight on the upward side of the motor 21 further than in a case where the above-described metal is used, making it possible to shift the center of gravity of the entire apparatus to the downward side. As a result, with the grip portion Gr provided on the downward side, it is possible to reliably position the center of gravity within the grip position. Further, since it is possible to reduce the weight of the entire apparatus, further improvements in portability and operability of the handheld type print label producing apparatus 1 can be achieved.

Further, in particular, the present embodiment, the keyboard part 3 operated by the operator is centrally disposed in the vicinity along the up and down direction corresponding to the grip portion Gr. With this arrangement, when the handheld type print label producing apparatus 1 is gripped by the operator, many of the operation keys that make up the keyboard part 3 are disposed in the vicinity of the grip position, making the apparatus easy to operate. With the keyboard part 3 centrally disposed in the vicinity of the grip portion Gr, the keyboard part 3 is provided in the vicinity of the position of the center of gravity of the handheld type print label producing apparatus 1. With this arrangement, the operator can operate the handheld type print label producing apparatus 1 in a more stable state than in a case where the apparatus is operated away from the center of gravity GV, thereby further improving operability.

Further, in particular, in the present disclosure, the grip portion Gr is provided across the entire range of the housing 6 along the up and down direction downward from the cartridge holder 7. With this arrangement, the cartridge holder 7 (in which the cartridge 31 is mounted), which is a light object, is disposed on the upward side of the housing 6, and the motor 21 and the battery housing part 9 (in which the battery 8 is mounted), which are heavy objects, are disposed on the downward side of the housing 6 corresponding to the grip portion Gr, making it possible to reliably position the center of gravity within the grip position.

While the above has been described in connection with an illustrative scenario in which the printed label tape 80 with print is cut by a cutter to produce the printed label, the present disclosure is not limited thereto. That is, in a case where a label mount (a so-called die cut label) separated in advance to a predetermined size corresponding to the label is continuously disposed on the tape fed out from the roll, the present disclosure may also be applied to a case where the label is not cut by the cutter but rather the label mount (a label mount on which corresponding printing has been performed) only is peeled from the tape after the tape has been discharged so as to form the printed label.

While the above employs a method wherein printing is performed on the cover film 51 separate from the base tape 53 and then the two are bonded together, the present disclosure is not limited thereto. For example, the present disclosure may also be applied to a method (a type that does not perform bonding) wherein printing is performed on the print-receiving tape layer provided to the base tape.

Furthermore, while the above has been described in connection with an illustrative scenario in which the base tape 53 and cover film 51 are wound around a spool so as to form a roll, and the roll is disposed within the cartridge 31 so as to feed out the label tape 80 with print, the present disclosure is not limited thereto. For example, an arrangement can be made as follows. Namely, a long-length or rectangular tape or sheet (including tape cut to a suitable length after being supplied from a roll) is stacked (laid flat and layered into a tray shape, for example) in a predetermined housing part so as to form a cartridge. The cartridge is then mounted to the cartridge holder 7 provided to the print label producing apparatus 1. Then, the tape or sheet is supplied or fed from the above-described housing part, and printing is performed so as to produce printed labels.

Furthermore, a configuration wherein the above-described roll is directly removably loaded to the print label producing apparatus 1 side, or a configuration wherein a long, flat paper-shaped or strip-shaped tape or sheet is moved one piece at a time from outside the print label producing apparatus 1 by a predetermined feeder mechanism and supplied to within the print label producing apparatus 1 is also possible. Additionally, the structure of the roll is not limited to a type that is removable from the print label producing apparatus 1 main body, such as the cartridge 31, but rather the roll may be provided as a so-called installation type or an integrated type that is not removable from the apparatus main body side. In each of these cases as well, the same advantages are achieved.

Additionally, other than those previously described, methods according to the above-described embodiment and modification examples may be utilized in combination as appropriate.

What is claimed is:

1. A handheld type print label producing apparatus configured to produce printed labels, comprising:

a housing that has a dimension along a longitudinal direction that is longer than a dimension along a width direction, and has a grip portion to be gripped by a hand of an operator;

a cartridge holder provided at one side of said housing along said longitudinal direction, in which a cartridge configured to supply a label tape is mountable;

a power source holder provided at the other side of said housing along said longitudinal direction, in which a power source device is mountable; and a motor that drives at least one roller positioned on a feeding path of said label tape, that is driven by power supplied from said power source device; wherein:

a plurality of mechanisms including said motor is disposed in the interior of said housing so that a position of the center of gravity along said longitudinal direction of said handheld type print label producing apparatus to which said cartridge and said power source device are mounted falls within a range of said longitudinal direction corresponding to said grip portion, by means of arranging that said motor and said power source holder are respectively disposed at said other side of said housing along said longitudinal direction, as well as at least one gear that transmits the power of said motor to said at least one roller, at least gear shaft that rotatably support said at least one gear, and at least one roller shaft that rotatably support said at least one roller are respectively formed by synthetic resin, and said cartridge holder is configured to mount said cartridge so that at least a part of said cartridge is positioned within a range along said longitudinal direction, the range corresponding to said grip portion.

2. The handheld type print label producing apparatus according to claim 1, wherein:

said cartridge includes a roll winding a base tape bonded to said label tape, said cartridge holder is configured to mount said cartridge so that said roll is positioned at one side of said housing along said width direction, and said motor is positioned at the other side of said housing along said width direction.

3. The handheld type print label producing apparatus according to claim 2, wherein:

said cartridge includes a cartridge case having a tape discharging exit said roll is disposed at an area in the tape discharging exit side inside said cartridge case, said housing includes a tape discharging slit at one end of the housing along said longitudinal direction, said tape discharging exit is configured to discharge said base tape out from said cartridge case, the base tape fed out from said roll of said cartridge by said at least one roller, the cartridge mounted in said cartridge holder, and said tape discharging slit is configured to discharge said base tape discharged from said tape discharging exit out from said housing.

4. The handheld type print label producing apparatus according to claim 2, wherein:

said cartridge includes a cartridge case, said cartridge case has a tape discharging exit at one end along a longitudinal direction of the cartridge case, said roll is disposed at an area in the one end along the longitudinal direction inside said cartridge case, said cartridge holder is configured to mount said cartridge so that the longitudinal direction of said cartridge case and the longitudinal direction of said housing match with each other and are offset from said grip portion longitudinal direction.

5. The handheld type print label producing apparatus in accordance with claim 1 further comprising a plurality of operation keys disposed in said grip portion.

* * * * *